US007111482B1

(12) United States Patent
Ghiran

(10) Patent No.: US 7,111,482 B1
(45) Date of Patent: Sep. 26, 2006

(54) PUNCH ASSEMBLY FOR HYDROFORMING DIE

(75) Inventor: Mike M. Ghiran, Lake Orion, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/225,328

(22) Filed: Sep. 13, 2005

(51) Int. Cl.
*B21D 26/02* (2006.01)
*B21D 28/28* (2006.01)
*B26D 7/28* (2006.01)

(52) U.S. Cl. ..... 72/55; 83/639.1; 100/289

(58) Field of Classification Search ..... 72/55; 83/639.1, 72; 100/289
See application file for complete search history.

(56) References Cited

U.S. PATENT DOCUMENTS 5,953,972 A * 9/1999 Nakagawa ..... 83/72
6,006,566 A * 12/1999 Huelsberg et al. ..... 72/55
6,401,507 B1 * 6/2002 Krcek et al. ..... 72/55
6,520,077 B1 * 2/2003 Minagawa et al. ..... 100/289
6,672,120 B1 * 1/2004 Ghiran et al. ..... 72/55
6,722,245 B1 * 4/2004 Yasoda et al. ..... 83/639.1

* cited by examiner

*Primary Examiner*—David B. Jones
(74) *Attorney, Agent, or Firm*—Laura C. Hargitt

(57) ABSTRACT

A punch assembly for a hydroforming die includes a servo motor, a ball screw connected to the servo motor, and a ball nut disposed about the ball screw for movement along the ball screw. The punch assembly also includes a link mechanism connected to the ball nut and a plunger operatively connected to the link mechanism and movable relative to the hydroforming die to allow fluid within a tubular member to force a wall portion of the tubular member outward against the plunger and be sheared by the hydroforming die to produce an opening in the tubular member.

15 Claims, 6 Drawing Sheets

PUNCH ASSEMBLY FOR HYDROFORMING DIE

TECHNICAL FIELD

The present invention relates generally to hydroforming and, more specifically, to a punch assembly for a hydroforming die.

BACKGROUND OF THE INVENTION

It is known to form a cross-sectional profile of a tubular member by a hydroforming process in which a fluid filled tubular member is placed within a cavity of a die and then the die is closed so that the tubular member is pinched within the die. Fluid pressure is then increased inside the tubular member to expand the tubular member outwardly against the cavity of the die to provide a tubular member having a die formed cross-sectional profile.

During tube hydroforming, large size punches of various shapes are used to create desired openings in the tubular member by piercing. The large punches currently used, necessitate similarly large activating hydraulic cylinders in order to overcome the forces needed for piercing. Large bore hydraulic cylinders need high volume of oil flow to operate, which is undesired.

As the number of hydroformed tube applications grows, the need for complex piercing also increases. Tubular members are not only designed with more openings, but also with larger openings, which, in turn, need larger hydraulic cylinders for piercing. This condition will increase the demand on the hydraulic system having a negative effect on controlling desired positioning, repeatability, and synchronization between multiple locations.

One method of piercing used in hyrdorforming application is "hydrapiercing". Upon completion of hydroforming, the tubular member is in intimate contact with the wall of the die. The hydroforming fluid is at a forming pressure, approximately 10,000 psi. A punch is attached to a hydraulic actuated cylinder. When the hydraulic cylinder is retracted, the high-pressure fluid will force the (non-supported) area of the tubular member outward, allowing the metal to be sheared and produce a slug. The "hydrapiercing" method is mostly used for piercing large openings as well as for hydroshearing operations. In order to support the forming pressure of approximately 10,000 psi or more, this method requires large hydraulic cylinders, which is undesired. Packaging as well as more hydraulic flow to operate large cylinders is a constant problem in designing hydroforming dies.

As a result, it is desirable to provide a punch assembly to pierce openings in a tubular member during the hydroforming process. It is also desirable to provide a punch assembly that can withstand extremely high forces. It is further desirable to provide a punch assembly that is more compact than a hydraulic cylinder of equal power. Therefore, there is a need in the art to provide a new punch assembly for a hydroforming die that meets these desires.

SUMMARY OF THE INVENTION

Accordingly, the present invention is a punch assembly for a hydroforming die including servo motor, a ball screw connected to the servo motor, and a ball nut disposed about the ball screw for movement along the ball screw. The punch assembly also includes a link mechanism connected to the ball nut and a plunger operatively connected to the link mechanism and movable relative to the hydroforming die to allow fluid within a tubular member to force a wall portion of the tubular member outward against the plunger and be sheared by the hydroforming die to produce an opening in the tubular member.

One advantage of the present invention is that a punch assembly is provided for a hydroforming die that has the ability to withstand extremely high forces. Another advantage of the present invention is that the punch assembly improves quality of an opening created in a tubular member during hydroforming. Yet another advantage of the present invention is that the punch assembly reduces down time during hydroforming. Still another advantage of the present invention is that the punch assembly incorporates a linkage assembly driven by a direct drive servo motor. A further advantage of the present invention is that the punch assembly allows for a faster process during hydroforming. Yet a further advantage of the present invention is that the punch assembly provides a significant improvement in the hydroforming process. Still a further advantage of the present invention is that the punch assembly increases the real-estate in hydroform dies for better packaging.

Other features and advantages of the present invention will be readily appreciated, as the same becomes better understood, after reading the subsequent description taken in conjunction with the accompanying drawings.

DESCRIPTION OF THE PREFERRED EMBODIMENT

Figure 1:
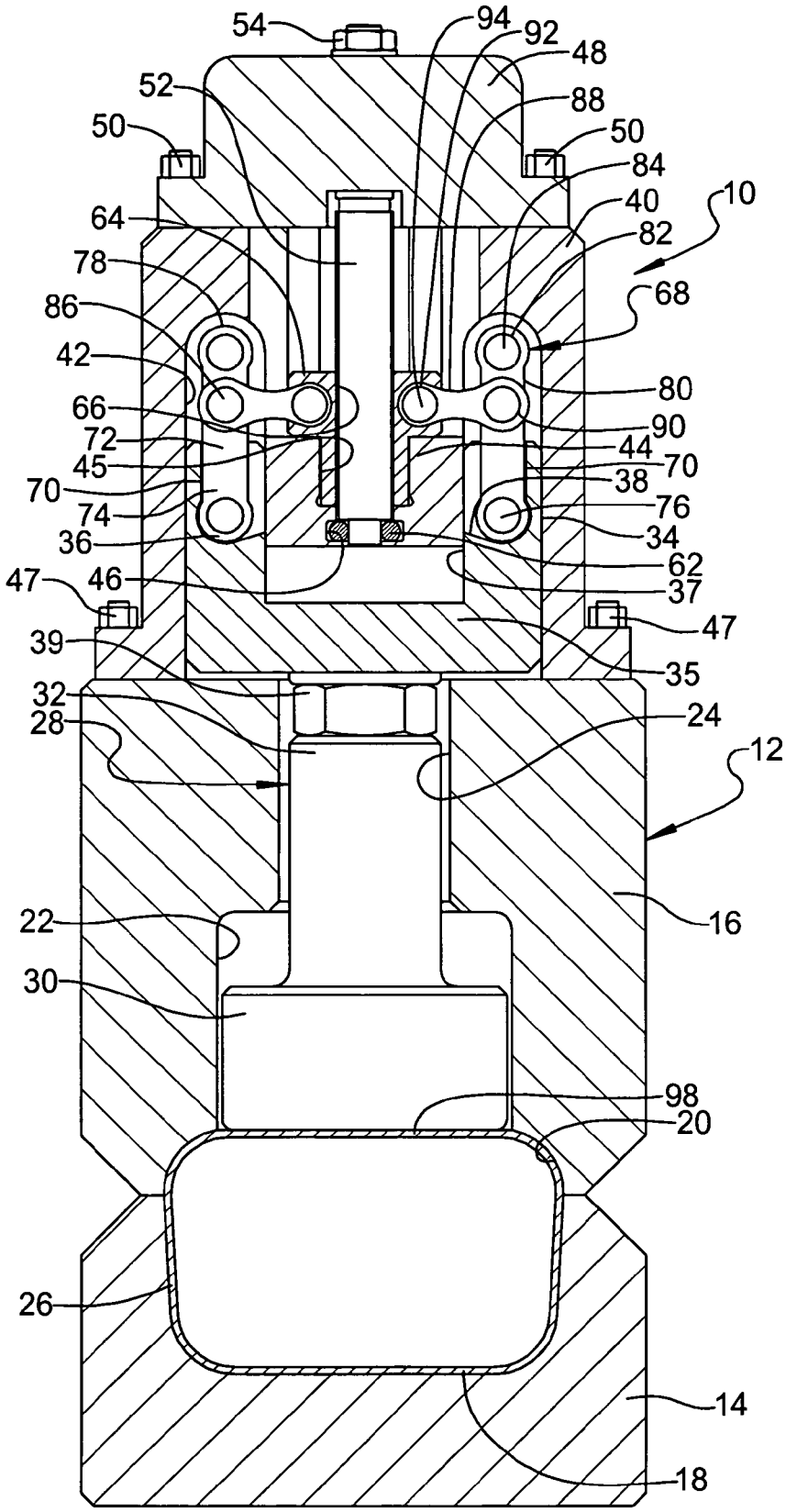
FIG. 1 is a fragmentary elevational view of a punch assembly, according to the present invention, illustrated in operational relationship with a tube and a hydroforming die.

Referring to the drawings and in particular FIG. 1, one embodiment of a punch assembly 10, according to the present invention, is generally shown for a hydroforming die, generally indicated at 12. The hydroforming die 12 is a die set comprised of a lower die half 14 and an upper die half 16. The lower die half 14 includes a tubular forming cavity portion 18. Likewise, the upper die half 16 includes a tubular forming cavity portion 20. The upper die half 16 includes a cavity 22 extending axially from the tubular forming cavity portion 20 and an aperture 24 extending axially from the cavity 22 and therethrough. It should be appreciated that a combined cross-sectional circumferential measure of the tubular forming cavity portions 18 and 20 total up to generally equal to or slightly greater than the cross-sectional circumferential measure of a tubular member 26.

The punch assembly 10 also includes a plunger, generally indicated at 28, disposed within the upper die half 16. The plunger 28 includes a head portion 30 extending radially and a shaft portion 32 extending axially from the head portion 30. The head portion 30 has a diameter greater than a diameter of the shaft portion 32. The head portion 30 is disposed in the cavity 22 and the shaft portion 32 extends through the aperture 24. The plunger 28 is made of a rigid material such as metal. The plunger 28 is a monolithic structure being integral, unitary, and one-piece. It should be appreciated that the plunger 28 is movable relative to the upper die half 16.

The punch assembly 10 includes a connecting bracket or member 34 extending from the shaft portion 32. The connecting bracket 34 has a generally "U" shaped cross-section. The connecting bracket 34 has a base portion 35 extending radially and an annular arm portion 36 extending from the base portion 35 to form a central cavity 37. The arm portion 36 has a recess 38 extending axially therein for a function to be described. The connecting bracket 34 is connected to the plunger 28 by a suitable mechanism such as a fastener 39. The connecting bracket 34 is made of a rigid material such as metal. The connecting bracket 34 is a monolithic structure being integral, unitary, and one-piece. It should be appreciated that the connecting bracket 34 and the plunger 28 may be a monolithic structure being integral, unitary, and one-piece.

The punch assembly 10 also includes a housing 40 supported upon the upper die half 16. The housing 40 includes a recess or cavity 42 extending axially therein. The housing 40 also has a body portion 44 with a central cavity 45 extending axially therein and a recess 46 at one end of the cavity 45. The housing 40 is connected to the upper die half 16 by a suitable mechanism such as fasteners 47. It should be appreciated that the arm portion 36 of the connecting bracket 34 is disposed in the cavity 42 of the housing 40.

The punch assembly 10 further includes a servo motor 48 supported upon the housing 40. The servo motor 48 is of a direct drive type. The servo motor 48 is connected to the housing 40 by a suitable mechanism such as fasteners 50. The servo motor 48 is electrically connected to a source of power such as an electronic controller (not shown) by a suitable mechanism such as wires (not shown). It should be appreciated that the servo motor 48 is conventional and known in the art.

The punch assembly 10 includes a ball screw 52 cooperating with the servo motor 48. The ball screw 52 extends axially and has a plurality of threads (not shown). The ball screw 52 has one end rotatably connected to the servo motor 48 by a suitable mechanism such as a fastener 54. It should be appreciated that the ball screw 52 is rotated by the servo motor 48.

The punch assembly 10 includes a bearing 62 disposed in the recess 46 of the body portion 44 of the housing 40 to rotatably support the other end of the ball screw 52. The bearing 62 is secured to the body portion 44 by a suitable mechanism such as press-fit into the recess 46. It should be appreciated that the bearing 62 is conventional and known in the art.

The punch assembly 10 also includes a ball nut 64 engaging the ball screw 52. The ball nut 64 has a generally "T" shaped cross-section. The ball nut 64 has an aperture 66 extending axially therethrough. The ball nut 64 has a plurality of threads (not shown) disposed about the aperture 66 to engage the threads of the ball screw 52. It should be appreciated that, when the servo motor 48 turns, being directly connected with the ball screw 52, the servo motor 48 will also turn the ball screw 52, thereby moving (forward or backward) the ball nut 64 along the ball screw 52. It should also be appreciated that, when the ball nut 64 is to move backward, the servo motor 48 will have to turn clockwise, assuming that the ball screw 52 is a right-hand thread ball screw.

The punch assembly 10 further includes a link mechanism, generally indicated at 68. The link mechanism 68 includes at least one, preferably a plurality of first linkages 70. The first linkages 70 extend axially between a first end 72 and a second end 74. The second end 74 is connected to the connecting bracket 34 by a suitable mechanism such as a pin 76. The link mechanism 68 also includes at least one, preferably a plurality of second linkages 78. The second linkages 78 extend axially between a first end 80 and a second end 82. The second end 82 is connected to the housing 40 by a suitable mechanism such as a pin 84. The first end 72 of the first linkage 70 is connected to the first end 80 of the second linkage 78 by a suitable mechanism such as a pin 86. The link mechanism 68 further includes at least one, preferably a plurality of third linkages 88. The third linkages 88 extend axially and have a first end 90 connected to the first end 72 of the first linkage 70 and to the first end 80 of the second linkage 78 by the pin 86. The third linkages 88 also have a second end 92 connected to the ball nut 64 by a suitable mechanism such as a pin 94. It should be appreciated that the linkages 70,78,88 rotate about the pins 76,86,94.

In operation, the tubular member 26 is disposed between the lower die half 14 and upper die half 16. The punch assembly 10 is used to produce an opening or hole in the tubular member 26. As illustrated in FIG. 1, the plunger 28 is raised such that the head portion 30 engages the wall of the tubular member 26. Upon completion of hydroforming, the tubular member 26 is in intimate contact with a wall of the cavity portions 18 and 20 of the die 12 and the head portion 30 of the plunger 28 as illustrated in FIG. 1.

Figure 2:
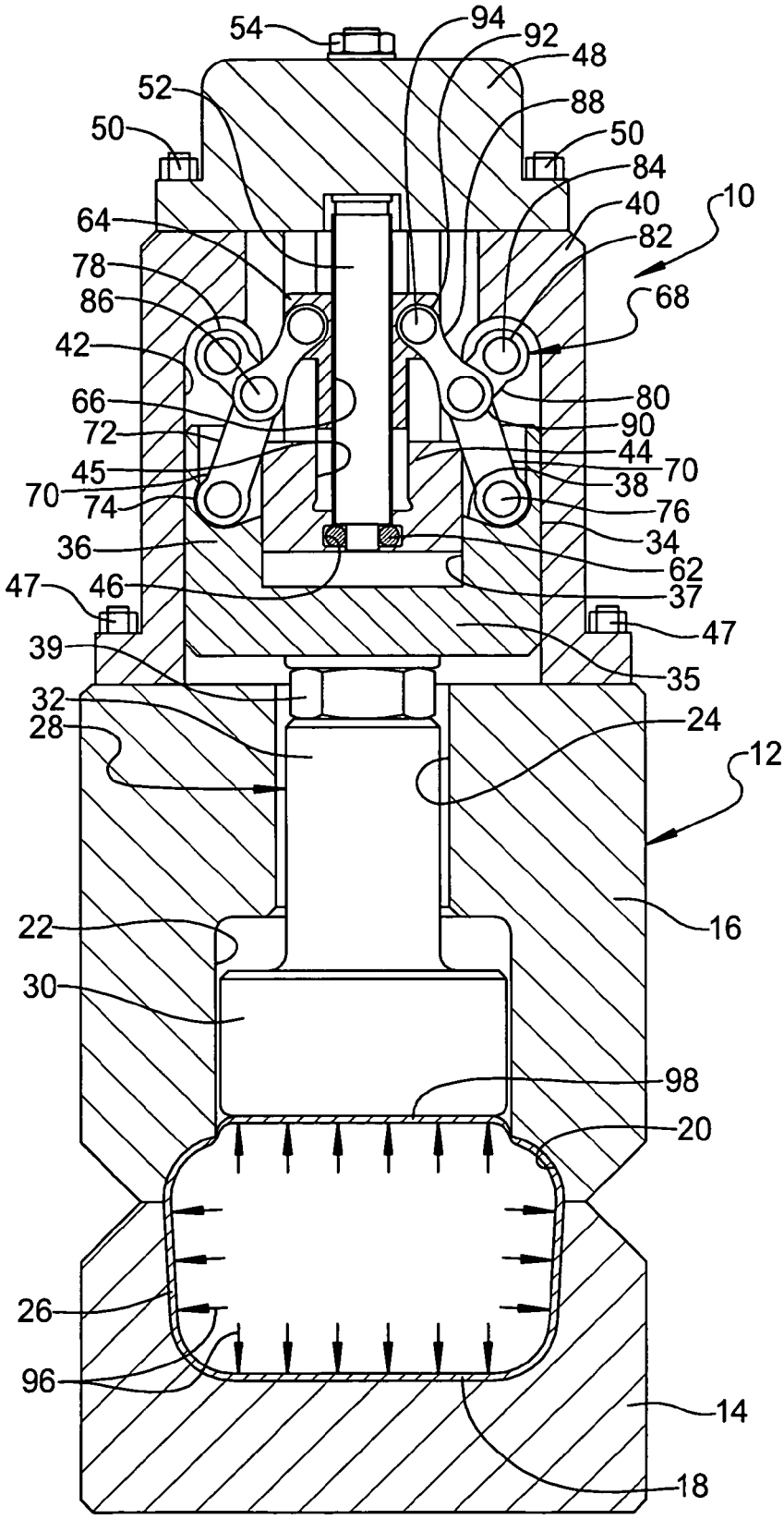
FIG. 2 is a view similar to FIG. 1 illustrating a first step of a piercing process.

Referring to FIG. 2, the hydroforming fluid 96 (indicated by arrows) in the tubular member 26 is pressurized to a forming pressure of approximately 10,000-psi. At this time, the tubular member 26 is formed and takes the shape of the cavity portions 18 and 20 by becoming in intimate contact with all surfaces of the cavity portions 18 and 20 including a surface of the head portion 30 of the plunger 28. The pressure exerted on the head portion 30 of the plunger 28 is transmitted directly to the first linkages 70 of the link mechanism 68 through the shaft portion 32 of the plunger 28 and the connecting bracket 34. The position of the third linkages 88 is perpendicular to the head portion 30 of the plunger 28 and the position of the second linkages 78 is perpendicular to the third linkages 88. In this position, all the force from the head portion 30 of the plunger 28 is diverted to the first and second linkages 70 and 78, and nothing or very negligible force is directed to the third linkages 88. It should be appreciated that the load on the servo motor 48 is negligible.

Figure 3:
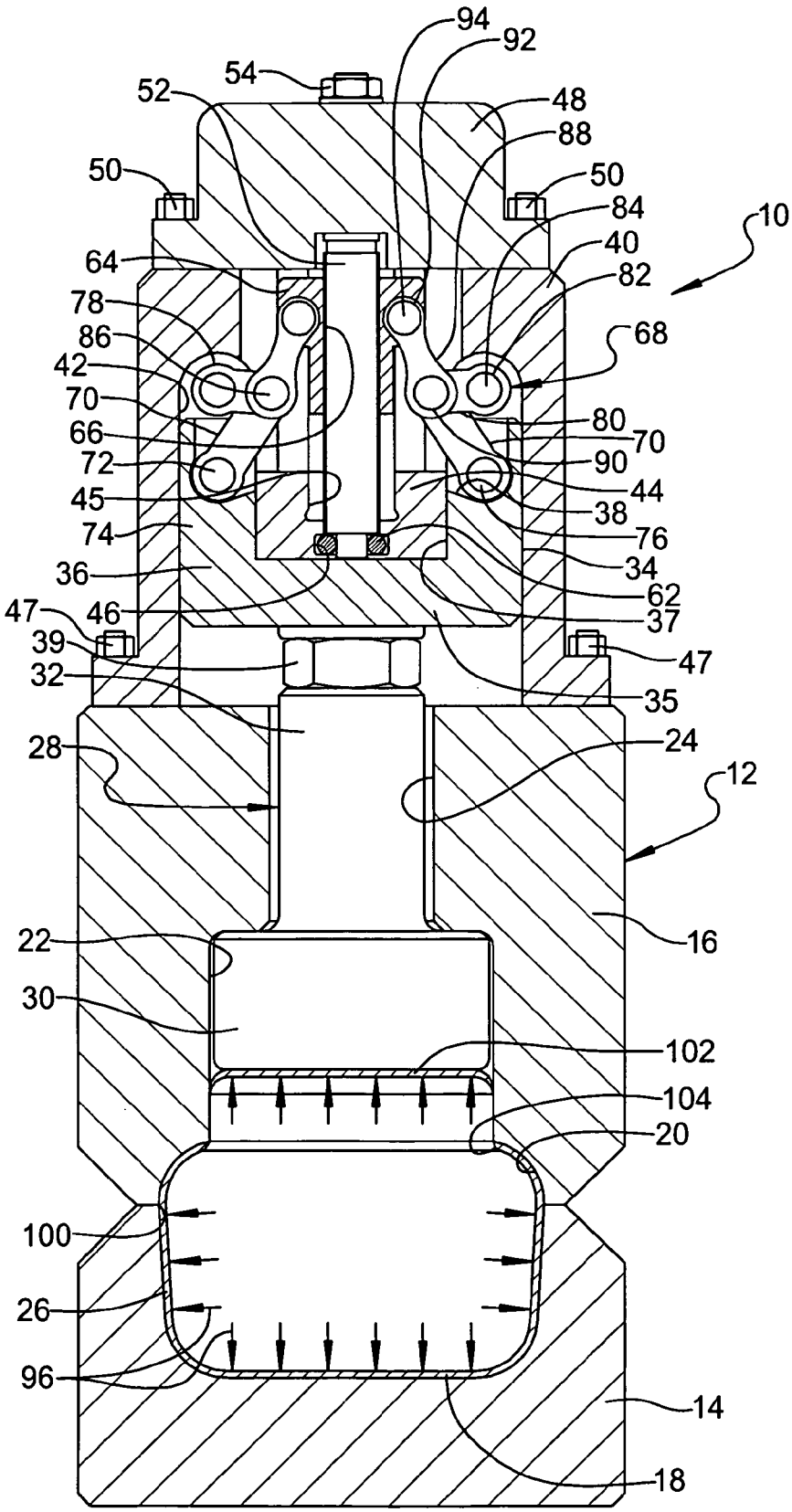
FIG. 3 is a view similar to FIG. 1 illustrating a second step of a piercing process.

As the ball nut 64 starts to move backward, the linkages 70 and 78 will follow the same movement. The third linkages 88 are engaged to the ball nut 64 and the second linkages 78 by rotating the pins 94 and 86, respectively. The backward movement of the ball nut 64 transmits the movement through the linkages 70,78,88, therefore engaging connecting bracket 34, shaft portion 32, and head portion 30 to move backward. During the backward movement of the plunger 28, the hydroforming fluid 96 is forcing a wall portion 98 of the tubular member 26 to stay in intimate contact with the surface of the plunger 28 and follow the movement of the plunger 28 as illustrated in FIG. 3. When this occurs, the wall portion 98 of the tubular member 26 is forced over a sharp edge 100 of the upper die half 16 and sheared by the sharp edge 100, producing a slug 102 as illustrated in FIG. 3. It should be appreciated that, when shearing occurs to produce the slug 102, an opening 104 is formed in the tubular member 26. It should also be appreciated that the backward movement is also helped by the forming pressure and therefore the load on the servo motor 48 is also negligible. It should further be appreciated that, later in the movement, the servo motor 48 will hold the backward movement, therefore needing to use more power in order to brake the movement.

Figure 4:
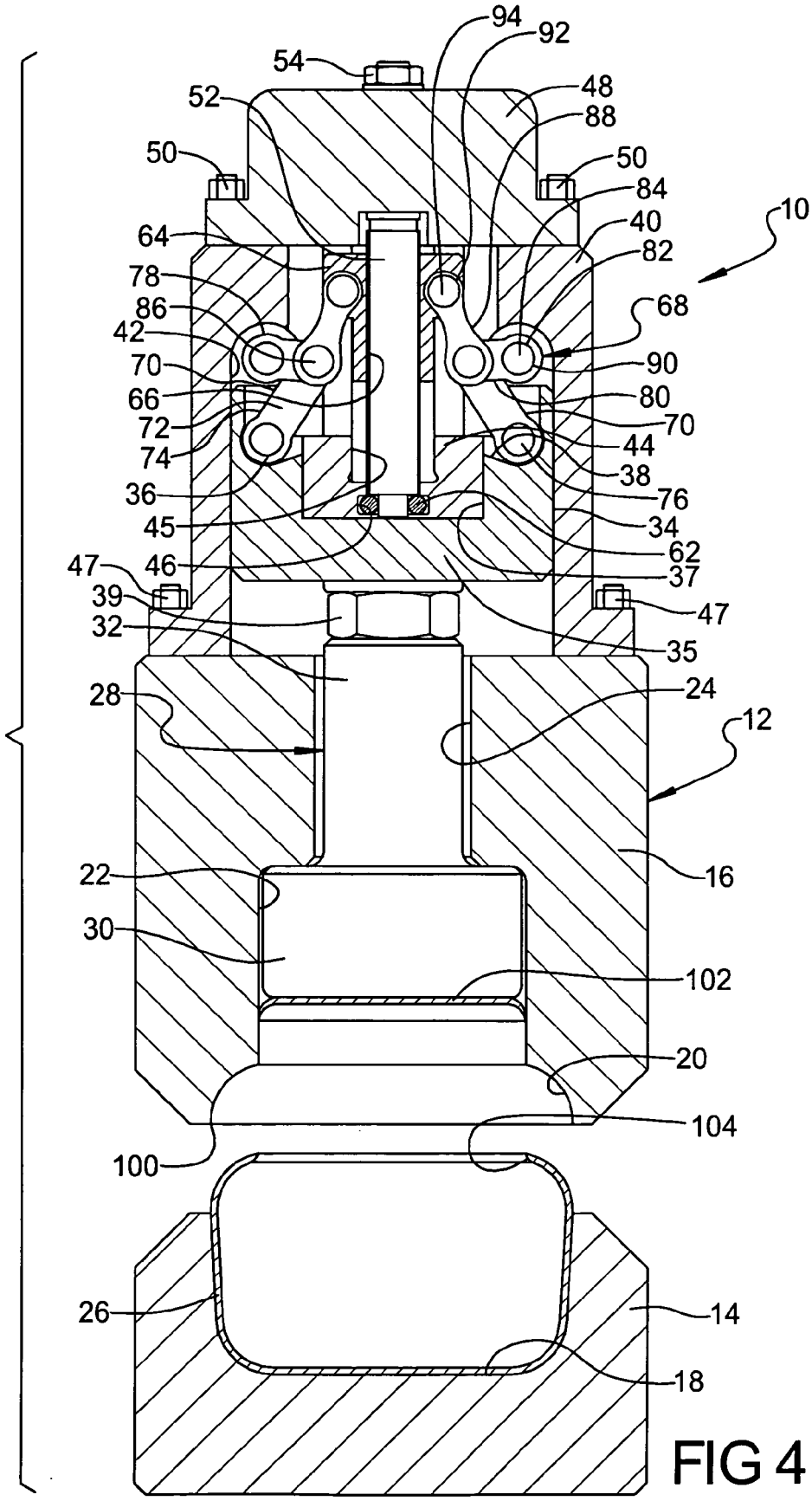
FIG. 4 is a view similar to FIG. 1 illustrating a third step of a piercing process

After shearing, as the backward movement of the plunger 28 continues, the slug 102 is forced by the forming pressure into the cavity 22. After the backward cycle is complete, the tubular member 26 is depressurized and the die 12 is opened as illustrated in FIG. 4. It should be appreciated that the slug 102 will remain press fit in the cavity 22.

Figure 5:
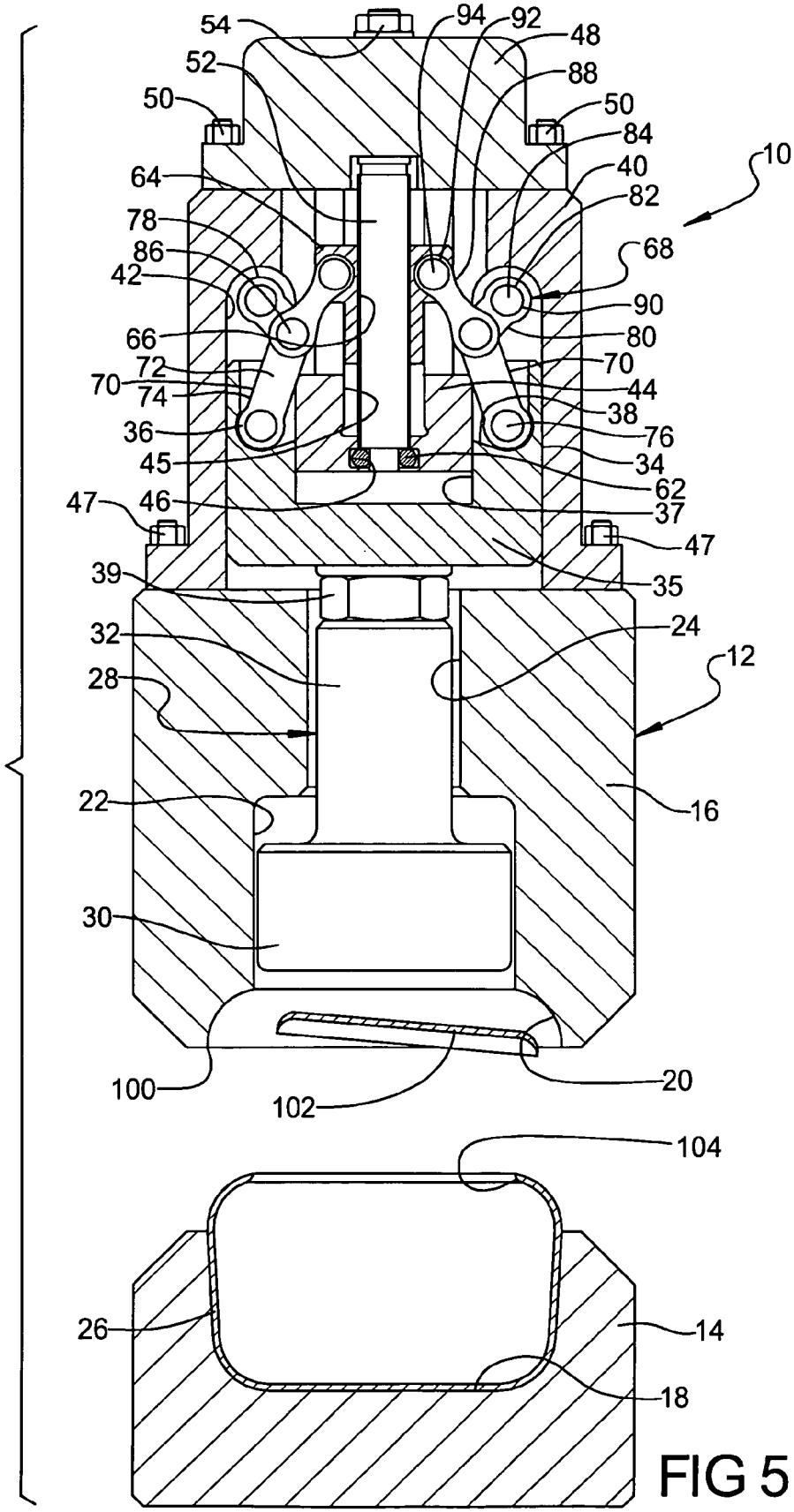
FIG. 5 is a view similar to FIG. 1 illustrating a fourth step of a piercing process.
Figure 6:
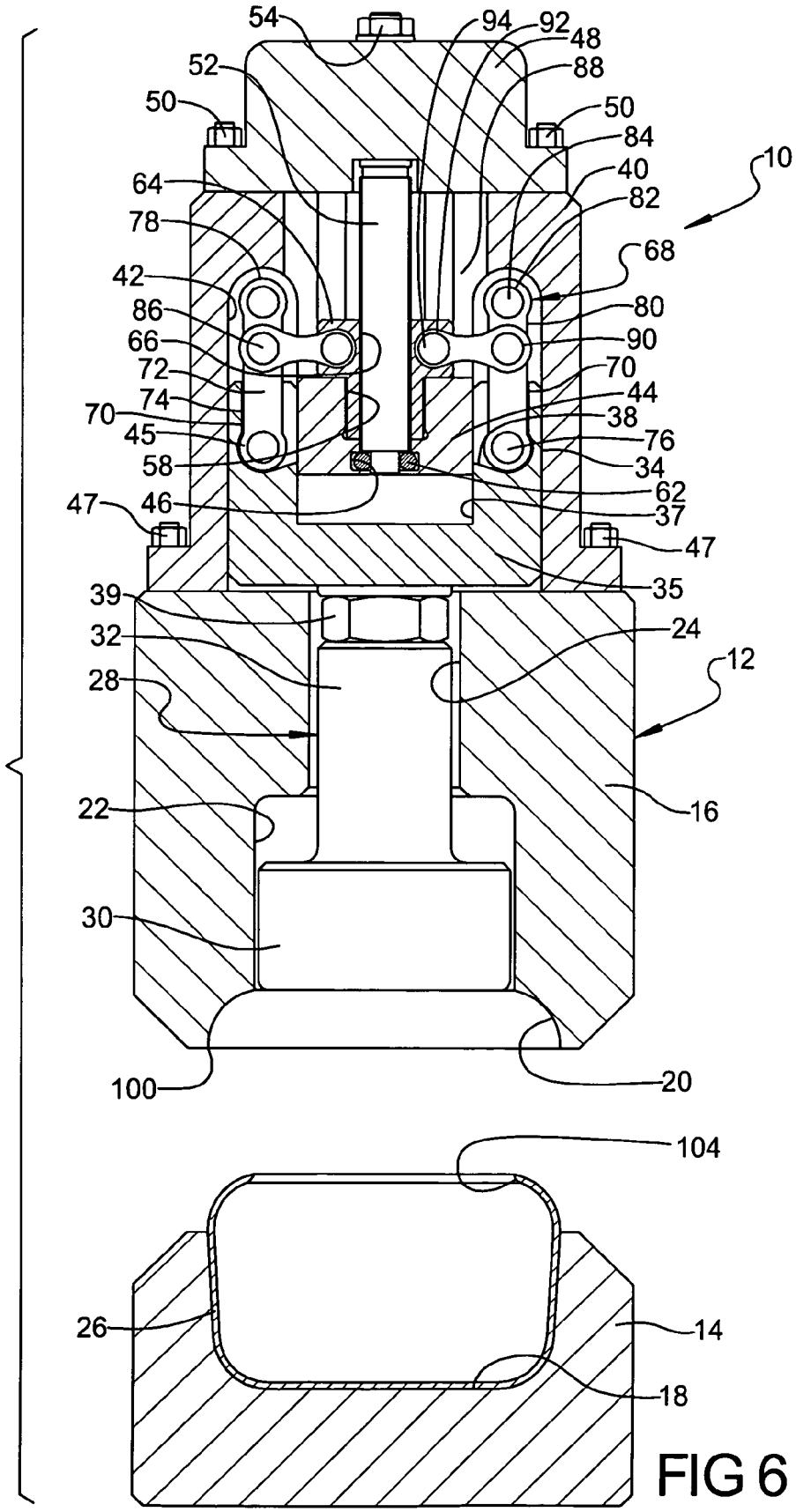
FIG. 6 is a view similar to FIG. 1 illustrating a final step of a piercing process.

By reversing the rotation of the motor 48, the plunger 28 will move forward, therefore pushing the slug 102 out from the cavity 22 and be diverted away from the cavity portion 20 of the upper die half 16 for disposal as illustrated in FIG. 5. The motor 48 then moves the plunger 28 forward to its starting position as illustrated in FIG. 6.

Accordingly, the punch assembly 10, when fully extended, has the ability to withstand extremely high forces. The punch assembly 10 is more compact then a hydraulic cylinder of equal power. The punch assembly 10 necessitates very low energy to operate, yet is very responsive to commands like positioning, repeatability, and synchronization between multiple openings or holes. The punch assembly 10 may be used for hydropiercing operations as well as multiple hydroshearing operations. The punch assembly 10 incorporates a link mechanism 68 for use in tubular hydroformed parts, for hydroshearing and large hole hydropiercing, primarily in situations of multiple holes or in multiple hydroshearing applications where repeatability and synchronization between piercing and shearing locations is needed. The punch assembly 10 incorporates this link mechanism 68 to minimize the use of hydraulic oil flow and will largely increase the real-estate in the hydroform die for better packaging as well as reducing cost in production operations by increasing quality and parts running longevity.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A punch assembly for a hydroforming die comprising:

a servo motor;

a ball screw connected to said servo motor;

a ball nut disposed about said ball screw for movement along said ball screw;

a link mechanism connected to said ball nut; and a plunger operatively connected to said link mechanism and movable relative to the hydroforming die to allow fluid within a tubular member to force a wall portion of the tubular member outward against said plunger and be sheared by the hydroforming die to produce an opening in the tubular member.

2. A punch assembly as set forth in claim 1 including a housing for attachment to a die half of the hydroforming die, wherein said servo motor is operatively supported by said housing.

3. A punch assembly as set forth in claim 2 wherein said link mechanism comprises a plurality of first linkages having one end connected to said plunger.

4. A punch assembly as set forth in claim 3 wherein said link mechanism comprises a plurality of second linkages having one end connected to said first linkages and another end connected to said housing.

5. A punch assembly as set forth in claim 4 wherein said link mechanism comprises a plurality of third linkages having one end connected to said first linkages and said second linkages and another end connected to said ball nut.

6. A punch assembly as set forth in claim 1 including a bracket interconnecting said plunger and said link mechanism.

7. A punch assembly as set forth in claim 6 wherein said bracket has a cavity extending axially therein.

8. A punch assembly as set forth in claim 1 wherein said plunger comprises a head portion extending radially and a shaft portion extending axially from said head portion.

9. A punch assembly as set forth in claim 1 wherein said servo motor is of a direct drive type.

10. A punch assembly as set forth in claim 1 including a plurality of pins to connect said linkages together at ends thereof.

11. A hydroforming die assembly comprising:

a lower die half having a die forming cavity;

an upper die half having a die forming cavity and a punch cavity extending axially therein and communicating with said die forming cavity; and a punch assembly being disposed in said punch cavity and operatively supported by said upper die half, said punch assembly having a servo motor and a movable plunger operatively connected to said servo motor for piercing an opening in a tubular member disposed between said upper die half and said lower die half;

wherein said punch assembly comprises a ball screw connected to said servo motor, a ball nut disposed about said ball screw for movement along said ball screw, and a link mechanism connected to said ball nut and said plunger.

12. A hydroforming die assembly as set forth in claim 11 including a housing attached to said upper die half, wherein said servo motor is operatively supported by said housing.

13. A hydroforming die assembly as set forth in claim 12 wherein said link mechanism comprises a plurality of first linkages having one end connected to said plunger.

14. A hydroforming die assembly as set forth in claim 13 wherein said link mechanism comprises a plurality of second linkages having one end connected to said first linkages and another end connected to said housing.

15. A hydroforming die assembly as set forth in claim 14 wherein said link mechanism comprises a plurality of third linkages having one end connected to said first linkages and said second linkages and another end connected to said ball nut.

* * * * *